United States Patent [19]

Courchesne

[11] Patent Number: 4,653,575

[45] Date of Patent: Mar. 31, 1987

[54] AIR-TO-AIR HEAT EXCHANGER

[76] Inventor: Germain Courchesne, 167 chemin du Golf, Drummondville, Canada, J2C 1K9

[21] Appl. No.: 835,873

[22] Filed: Mar. 3, 1986

[51] Int. Cl.[4] ..... F24F 7/08; F24H 3/02

[52] U.S. Cl. ..... 165/54; 165/76; 165/78; 165/135; 165/158; 165/159; 165/905

[58] Field of Search ..... 165/54, 76, 78, 905, 165/135, 158, 159

[56] References Cited

U.S. PATENT DOCUMENTS

| | | | |
|---|---|---|---|
| 1,536,675 | 5/1925 | Le Londe | 165/76 |
| 2,226,243 | 12/1940 | Herz | 165/76 |
| 4,563,126 | 1/1986 | Kobayashi et al. | 165/54 |

FOREIGN PATENT DOCUMENTS

| | | | |
|---|---|---|---|
| 3217606 | 12/1982 | Fed. Rep. of Germany | 165/54 |
| 3233910 | 3/1984 | Fed. Rep. of Germany | 165/54 |
| 2095394 | 9/1982 | United Kingdom | 165/54 |

*Primary Examiner*—Albert W. Davis, Jr.

[57] ABSTRACT

A heat exchanger for ventilating insulated dwellings with minimum internal heat loss, is disclosed. The heat exchanger is characterized by its very low manufacturing cost, its excellent efficiency and its minimum and easy maintenance. The heat exchanger consists of an elongated box-like casing forming two opposite end chambers interconnected by a plurality of longitudinally-extending, thin walled glass tubes. Warm stale and humid air is expelled through the glass tubes from one to the other chamber, while cool outdoor drier air is circulated within the casing along a generally sinusoidal path about the glass tubes, so that a heat transfer occurs through the walls of the glass tubes. The casing is made of molded foam plastic for good heat insulation and in two half-parts having inner edges releasably and sealingly joined by a tongue-and-groove arrangement. Each half-part has a tongue and a groove, each extending along half the periphery of its inner edge, so that the half-parts can be made in the same mold. The casing is provided with a closure device, which can be easily released to open the two half-parts for easy maintenance of the inside of the heat exchanger.

18 Claims, 28 Drawing Figures

Fig. 1
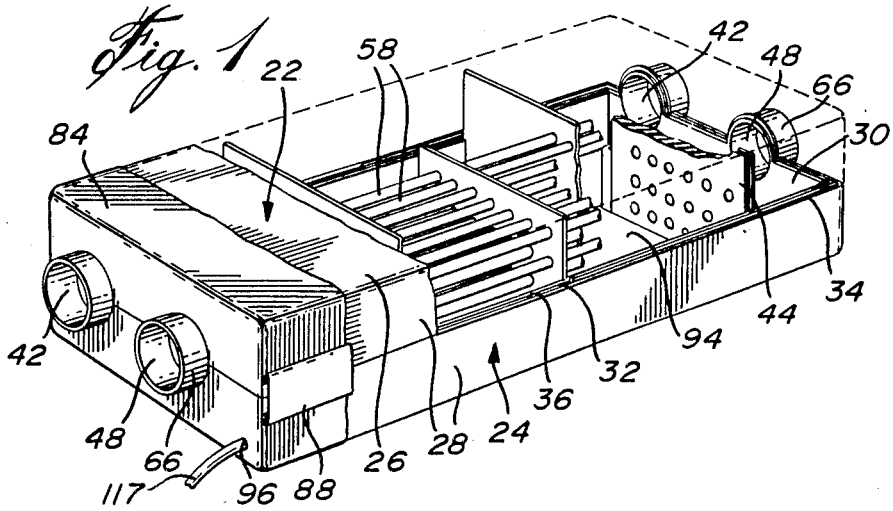
Fig. 3
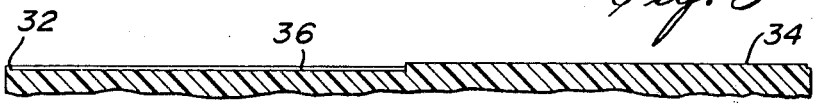
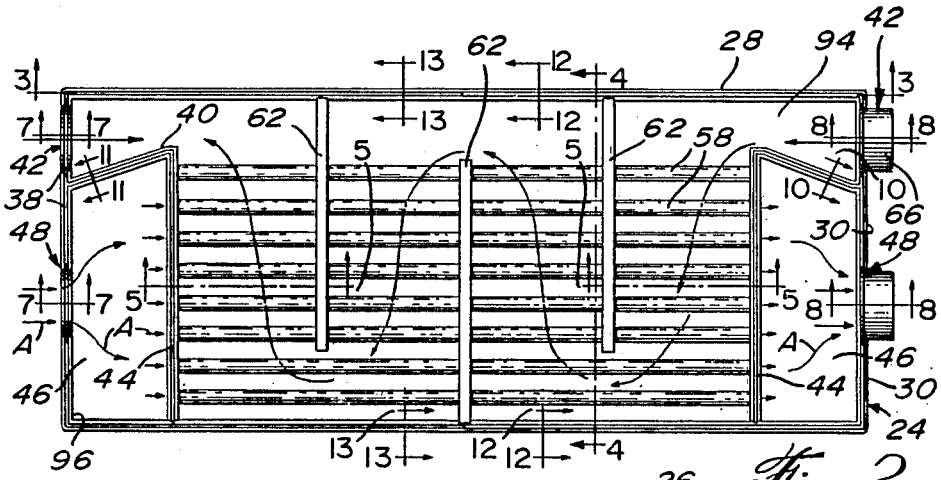
Fig. 2
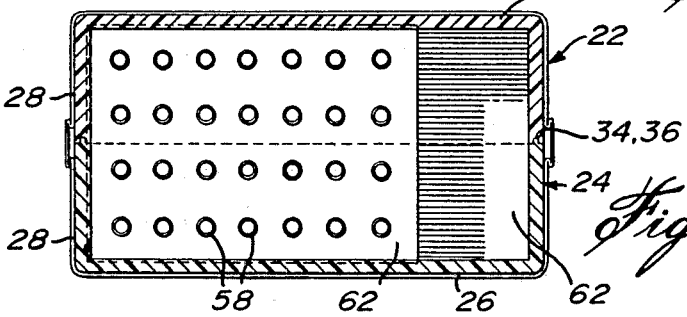
Fig. 4

Fig. 26
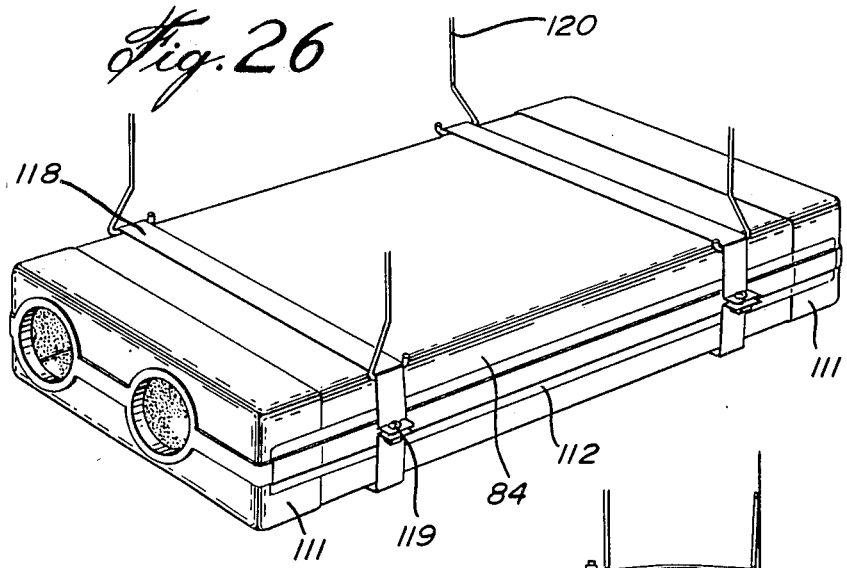
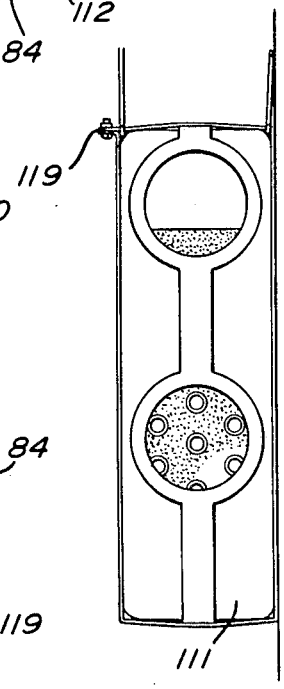
Fig. 28
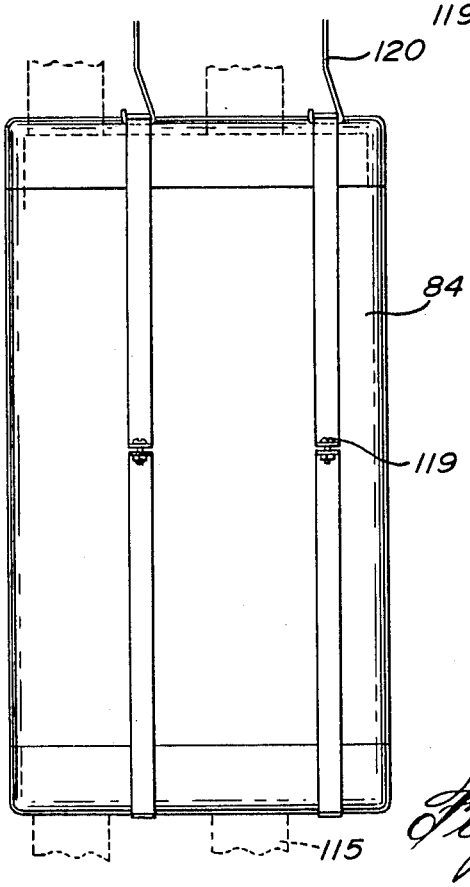
Fig. 27

AIR-TO-AIR HEAT EXCHANGER

FIELD OF THE INVENTION

This invention relates to air-to-air heat exchangers and is more particularly designed to ventilate dwellings with a minimum loss of internal heat.

BACKGROUND OF THE INVENTION

In cold climates, dwellings are not only insulated but are substantially airtight to avoid heat loss. It is accordingly essential to provide for an adequate ventilation of the dwellings, and this is more and more accomplished by adjoining to the ventilation system, air-to-air heat exchangers to transfer the heat content of the expelled stale air to the incoming fresh and cold air, therefore maintaining the heating cost within reasonable limits. Known air-to-air heat exchangers for the purpose described are quite complex in their construction and, therefore, costly to manufacture and, moreover, they require special knowledge and tools to effect cleaning of the same. Therefore, the dwelling owner cannot generally effect maintenance of such heat exchangers. The above drawbacks are apparent, for example, in the Canadian Patent No. 1,153,360, issued Sept. 6, 1983 to Allen et al.

OBJECTS OF THE INVENTION

An object of the present invention is to provide an air-to-air heat exchanger, which is very efficient and yet of very low manufacturing cost.

Another object of the invention is that it requires little maintenance, said maintenance being easily carried out.

Another object of the present invention is that the heat exchanger is very easy to install in any oriented position.

Another object of the invention is to provide a heat exchanger that is very long-lasting and which does not require defrosting of the stale air flow path.

SUMMARY OF THE INVENTION

The heat exchanger of the invention comprises an elongated box-shape casing forming two opposite end chambers; a plurality of thin walled glass tubes extend longitudinally of the casing between the two end chambers and communicate with the same; inlet and outlet ports for said end chambers; said glass tubes and chambers and first-named-ports defining a first air path; second inlet and outlet ports communicating with the casing space surrounding said tubes and defining a second air path; and baffles alternately extending from opposite walls of said casing and terminating short of the opposite wall and surrounding said tubes to cause the air of said second air path to flow in a generally sinusoidal path about said tubes. Said casing is preferably made of two half-parts having inner edges releasably and sealingly joined by a tongue-and-groove arrangement. Preferably, each half-part has a tongue and a groove, each extending along half the periphery of its inner edge, so that the two half-parts can be molded in the same mold, preferably out of foam plastic material. Preferably, the baffles and also a wall of each of said end chambers are releasably mounted within said casing, so that said baffle tubes and walls can be formed into an assembly, which can be inserted and removed from the casing.

The casing is preferably protected against abuse by an outer covering.

Means are also provided to install the heat exchanger on a wall or suspended from a ceiling, with means to gain easy access to the heat exchanger. Preferably, the glass tubes are those provided for the manufacturing of fluorescent tubes in the lighting industry, forming thin walls and very smooth inside and outside surfaces for minimum cleaning.

BRIEF DESCRIPTION OF THE DRAWINGS

FIG. 1 is a downwardly-looking perspective view of the heat exchanger in accordance with the invention, partly broken away to show the interior;

FIG. 2 is a top plan view of the bottom half-part of the heat exchanger showing the assembly of the glass tubes, baffles and end chamber walls installed therein;

FIG. 3 is a partial vertical section taken along line 3—3 of FIG. 2;

FIG. 4 is a cross-section taken along line 4—4 of FIG. 2 but with the top half-casing part in closed position;

FIG. 26 is a perspective view of the heat exchanger in accordance with FIG. 20 and partially showing the means to suspend to same from a ceiling;

FIG. 27 is an elevation of the same heat exchanger as suspended in vertical position, together with broken end portions of the air conduits in dotted lines; and FIG. 28 is an end view of the heat exchanger as suspended in another position.

DETAILED DESCRIPTION OF THE PREFERRED EMBODIMENTS OF THE INVENTION

Figure 5:
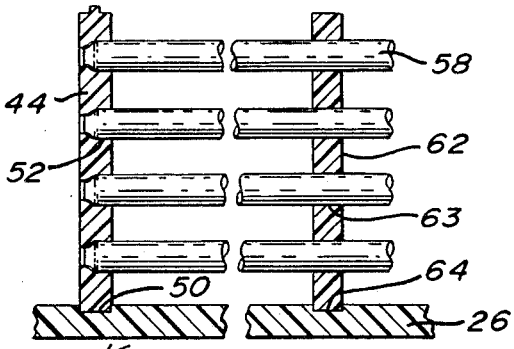
FIG. 5 is a partial longitudinal section taken along line 5—5 of FIG. 2.

The air-to-air heat exchanger in accordance with the invention comprises a box-like elongated casing, of generally rectangular shape, and made of two half-casing parts 22 and 24, half-part 22 being the top part of the heat exchanger and half-part 24 the bottom part of the heat exchanger for the purpose of the description only. Both parts are made of insulating material and are preferably molded from a thermo-plastic closed-cell foam. Each half-part 22, 24 consists of a main wall 26, of generally rectangular shape and flat and from the periphery of which depends a skirt made from longitudinal side walls 28 and end walls 30, defining a free edge extending along the entire periphery of the casing half-part. The two half-parts are of similar shape and size, so that they can be closed one against the other at their free edge 32 to form a completely-closed casing. The junction between the two half-parts is sealed by a tongue-and-groove arrangement as follows (see FIGS. 3, 20, 22 and 23).

Figure 6:
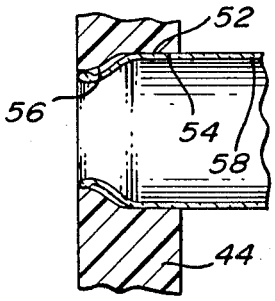
FIG. 6 is an enlarged longitudinal section of part of FIG. 5.
Figure 10:
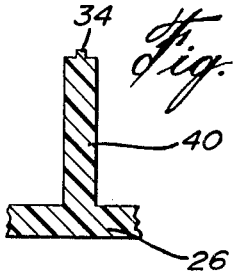
FIGS. 10, 11, 12 and 13 are partial enlarged sections taken along lines 10—10, 11—11, 12—12 and 13—13, respectively, of FIG. 2.
Figure 11:
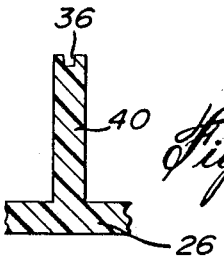
Figure 12:
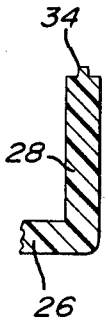
Figure 13:
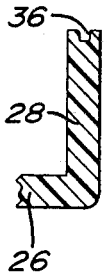

The bottom half-part 24 has a tongue 34 which extends around half the periphery of its free edge 32 and a groove 36 which extends around the other half of the periphery of its free edge 32, the tongues 34 and grooves 36 being adapted to sealingly engage one another when the two half-parts are matched in fully-closed position. In this way, the two half-parts may be made in the same mold, being of identical shape, and the tongues of one half-part mating with the grooves of the other half-part when the two half-parts are reversed to form the closed casing. Both end walls 30 of each half-part 22, 24 are formed with a half-circular opening 38, to define a fully-circular port: two at each end of the casing, when the casing is closed. Each half-part is integrally molded with two internal wall sections 40, each depending and integrally molded with the respective end walls 30 and with the main wall 26, and each directed inwardly of the casing and inclined with respect to the longitudinal axis of the casing towards the centreline of the longitudinally-aligned cold air ports 42. These internal wall sections 40, together with a removable internal wall 44, form with each end wall 30 an end chamber 46 in respective communication with the hot air ports 48, which are also longitudinally aligned with respect to the casing. The integral internal wall sections 40 have the same height as the side walls 28 and end walls 30, and one internal wall section 40 has a tongue 34 at its free edge, while the other internal wall 40 has a groove 36 at its free edge, so that these tongue-and-groove arrangements are also matching when the two half-casing parts are closed (see FIGS. 10 and 11). Each partition wall 44, one at both ends of the casing, is of generally rectangular shape and is of the full height of the internal space of the casing, being also made of molded foam plastic and removably engaging a groove 50 (see FIG. 5) which is made at the inside surface of the main wall 26 and also at the inside surface of one longitudinal side wall and, finally, at the free end of the internal wall section 40. These partition walls 44 (see FIGS. 5 and 6) are provided with a plurality of through bores 52 arranged in horizontal rows, with the through bores of intermediate rows preferably staggered relative to two adjacent rows. The through bores, when seen in cross-section (see FIG. 6) have an inner cylindrical portion 54 and an outer tapered portion 56, so that a cylindrical glass tube 58, having a tapered end, can be fitted and axially retained within the through bores 52, it being understood that both ends 50 of each glass tube are tapered and that the two partition walls 44 are positioned within the casing in reverse position, so that the tapered outer ends 56 of the through bores 52 will be on the side facing the end chamber 46. Thus, the tubes are axially retained in both directions and yet can be easily released from the partition wall. Each partition wall can therefore be made in the same mold and each will be made of molded foam plastic. The heat exchanger is further provided with a series of baffles 62. Each of the baffles forms a rectangular flat plate and they are removably fitted within groove 64 made at the inside surfaces of the main wall 26 and longitudinal side walls 28. These baffles 62 extend the whole height of the casing but have a length smaller than the width of the casing so, once installed, the baffles will alternately extend from one longitudinal side wall 28 to terminate short of the opposite longitudinal side wall 28, as clearly shown in FIG. 2, wherein three such baffles are shown, all disposed parallel to the partition walls 44 and equally spaced one from the other and from the adjacent partition walls 44. These baffles 62 are provided with a series of cylindrical through bores 63 in which the glass tubes 58 engage and extend with a friction-fit. These baffles 62 are also molded of foam plastic. The glass tubes 58 are preferably thin wall cylindrical tubes having, for instance, a wall thickness of 60 mils and are obtained from manufacturers of fluorescent lighting, of standard 4' length. They can be obtained in completely transparent state.

The several glass tubes 58, together with the baffles 62 and partition walls 44, can be pre-assembled and the assembly installed, for instance, in the bottom half-part 24 of the casing. Then the top half-part 22 will be fitted on not only the peripheral edge of the bottom half-part but also over the top edges of baffles 62 and partition walls 44, thereby completing the assembly in a very fast and simple manner.

Figure 7:
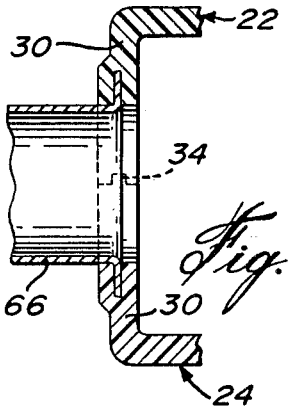
FIGS. 7 and 8 are partial longitudinal sections taken along lines 7—7 and 8—8 respectively of FIG. 2.
Figure 8:
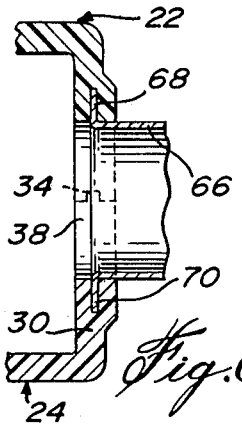

The cold air ports 42 and the hot air ports 48 are provided with means for connection to the ventilating circuit. In the embodiment of FIGS. 7 and 8, and also shown in FIGS. 1 and 2, cylindrical metallic nipples 66 are formed in conventional manner with a radially outer annular flange 68 at their inner end to removably engage a groove 70 made in each half-circular opening 38, so that the nipples 66 can be installed in the bottom casing part 24, retained in the groove 70 and, thereafter, the top casing part 22 is closed not only on the tube assembly but also on the nipples. These nipples are adapted to be connected to flexible ventilation conduits, not shown.

Figure 9:
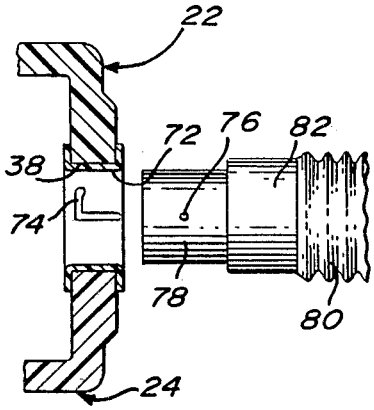
FIG. 9 is a partial longitudinal section, similar to that of FIG. 8 but of another embodiment of the means for connecting the heat exchanger to the air ventilation circuits.
Figure 19:
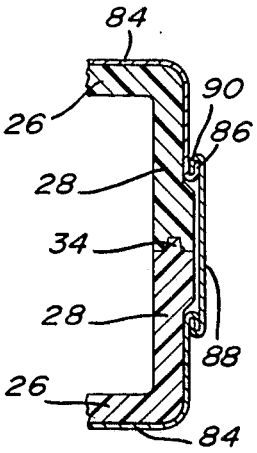
FIG. 19, seen on the third sheet of drawings, is a partial cross-section of the casing, envelope and clamping means.
Figure 25:
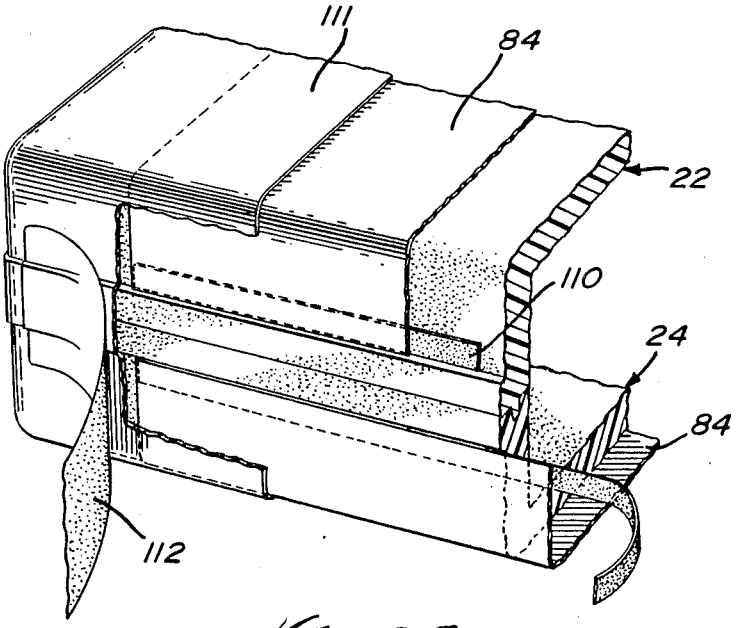
FIG. 25 is a partial perspective view of the assembled half-parts.

FIG. 9 shows another embodiment of the means to connect the heat exchanger to the ventilating circuit. In this embodiment, a double flange cylindrical metallic bushing 72 is fitted in the half-opening 38 with its flanges engaging the outside and the inside surfaces of the end walls 30 of the two casing half-parts. Here again, the bushing 72 may be installed in the same manner as the nipple 66. Bushings 72 are preferably provided with bayonnet type grooves 74, preferably at two diametrically-opposed locations, for receiving diametrically-opposed pins 76 of a cylindrical nipple 78, which is inserted and partially rotated within the bushing 72. This nipple is connected to a flexible conduit 80 by means of a strapping 82, of conventional construction. Because it is made of foam plastic, and therefore subjected to abuse especially during shipping, the casing is preferably covered with a protecting envelope, indicated at 84, in FIG. 1 and also in FIGS. 19 and 25. This envelope 84 is also made of two half-parts conforming in shape and size to the two half-casing parts 22 and 24 to completely enclose the casing. The longitudinal edges of the two half-parts of the envelope 84 are outwardly folded, as shown at 86 in FIG. 19, to slidably receive a clamping member 88 in the form of a strip with inturned longitudinal edges 90 to slidably longitudinally engage the hook-shape folded edges 86 of the envelope half-parts. Therefore, the clamping strip 88 not only serves to maintain the casing half-parts in closed position but also to secure the envelope 84 around the same. This envelope 84 can be made of a relatively rigid plastic material, which serves also as a shipping container for the heat exchanger.

Figure 20:
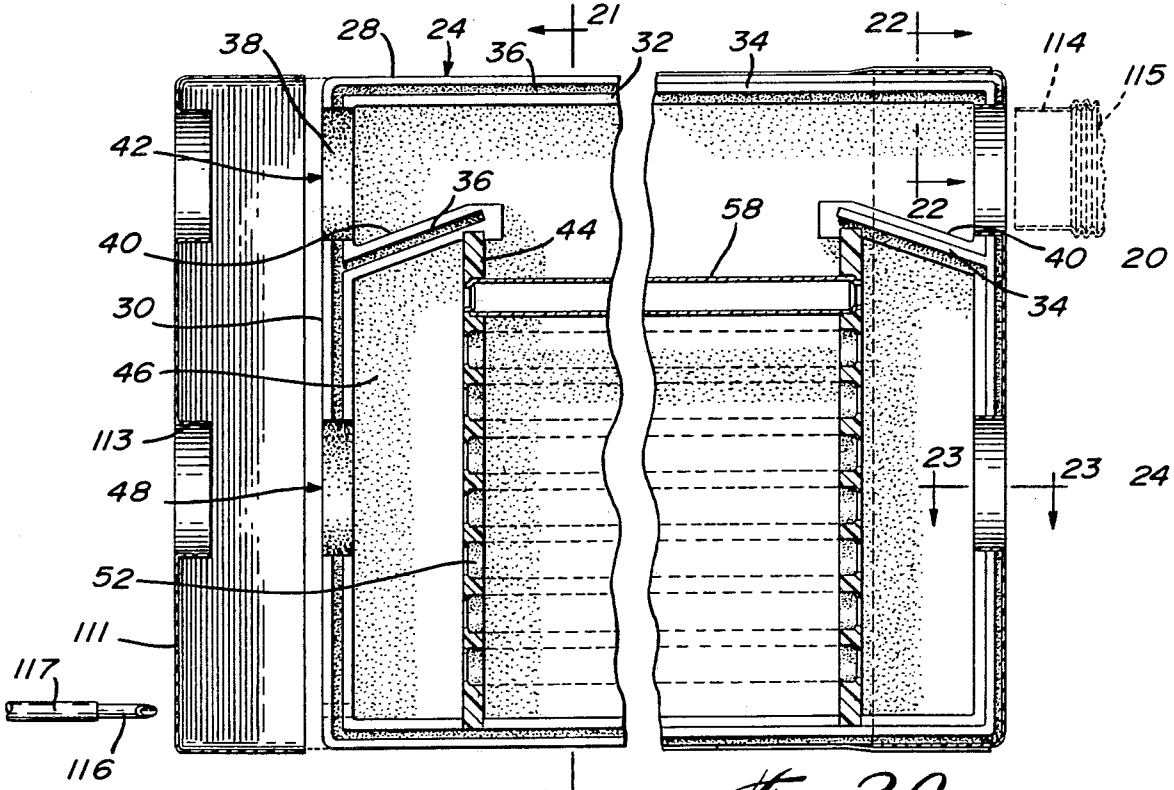
FIG. 20 is a top plan view of the bottom half of the heat exchanger, similar to FIG. 2 but broken away and showing a modified means for closing the two half-parts of the heat exchanger.
Figure 22:
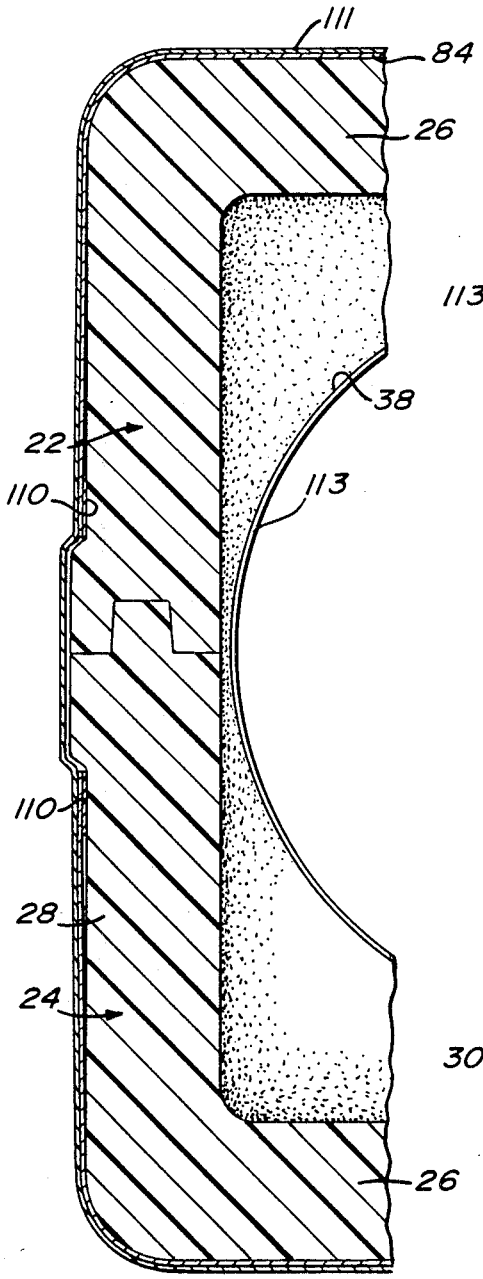
FIG. 22 is a section taken along line 22—22 of FIG. 20, on an enlarged scale, and with the top half-part in position.
Figure 23:
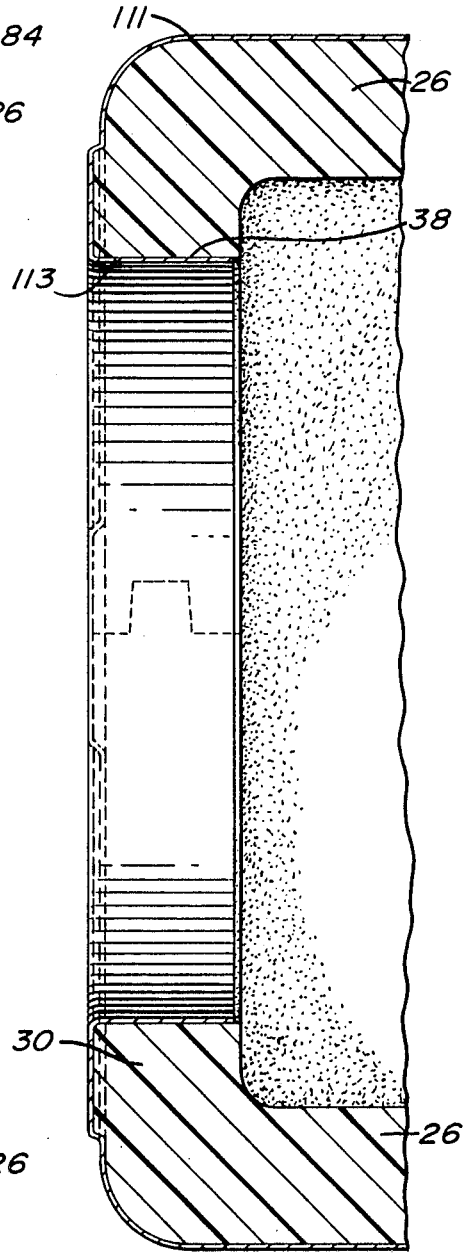
FIG. 23 is a section taken along line 23—23 of FIG. 20, on an enlarged scale, and with the top half-part in position.
Figure 24:
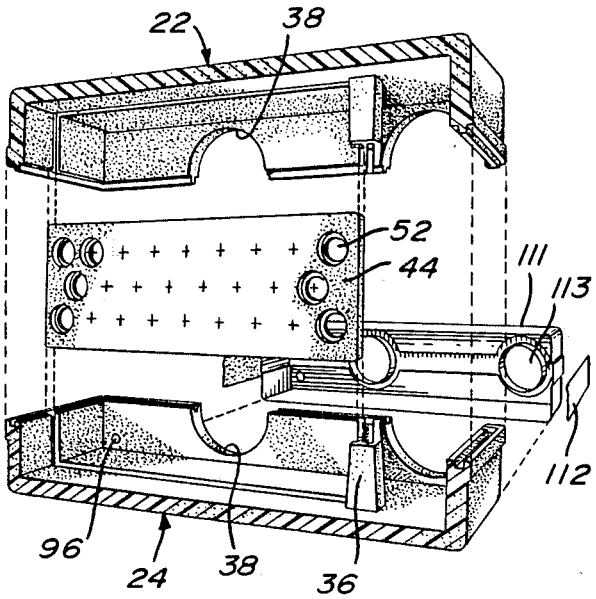
FIG. 24 is an exploded, partial perspective view of the modified heat exchanger in accordance with FIG. 20, looking towards the hot air inlet port.

As shown in FIGS. 20, 22, 23 and 25, the two half-parts of envelope 84 may be secured to the heat exchanger casing half-parts by a pressure adhesive strip 110 and the envelope 84 preferably extends short of the ends of the casing. An end cap 111 is fitted to each end of the assembled heat exchanger casing as to overlap the envelope parts 84 and so as to maintain the two heat exchanger casing parts in assembled position. Then, a pressure adhesive tape 112 is applied to the end caps 111 and against the junction of the casing half-parts 22, 24 and against the edges of the protecting envelope 84 so as to completely close and seal the heat exchanger. With this arrangement, it is easy to remove the sealing strip 112 and remove the end caps 111 for access to the interior of the heat exchanger. The end caps 111 are preferably molded with integral inwardly extending circular flanges 113, as shown in FIGS. 20 and 24, which frictionnally fit within the respective ports of the heat exchanger casing and which serve as a friction connection for the end cylindrical nipple 114, as shown in FIG. 20, of a standard flexible air conduit 115.

Referring to FIG. 2, the heat exchanger is connected in the ventilation circuit preferably in the following manner.

Hot stale air from the dwelling enters the left-hand end chamber 46 through the associated hot air port, 48 and flows in the direction of arrows A through the glass tubes 58, then out of the other end chamber 46 and to the exterior of the building through the right-hand hot air port 48 by a suitable conduit. The cold air circulates in a counterflow arrangement, entering directly the interior space 94 of the casing through the right-hand cold air port 42, then flowing around the several glass tubes 58 in a zigzag or sinusoidal path due to the presence of the baffles 62, to finally issue into the dwelling through the left-hand hot air port 48. There is a good heat exchange between from the hot air to the cold air due to the small wall thickness of the glass tubes 58, the total heat exchange surface which is increased by providing for a maximum of glass tubes 58, as made possible by the inclination of the internal wall sections 40 and also due to the fact that the inside and outside of the glass tubes stay clean for a long time due to their smooth surfaces. The hot stale air from the dwelling is generally humid and the condensation which might take place at the inlet ends of the glass tubes 58 will be expelled from the casing through an opening 96 made at the adjacent corner of the main wall 26, it being noted that the casing, during its installation, will be slightly downwardly inclined towards said condensate outlet opening 96. Even during very cold weather, it has been found that the smooth glass surface of the tubes 58 prevents adherence thereto of any frost which may be formed inside the tubes. Therefore, the tubes remain free of any obstruction even when the outside temperature is very low. As shown in FIGS. 1 and 2, the condensate may be laid out of the condensate outlet opening 96 by providing a bevelled rigid nipple 116 fitted with a flexible tube 117. The bevelled nipple 116 is simply forced through the end cap 111 and through the foam material of the heat exchanger casing of the lowermost corner of the casing.

A heat exchange efficiency of about 70% has been found during tests carried out with the present heat exchanger.

Figure 15:
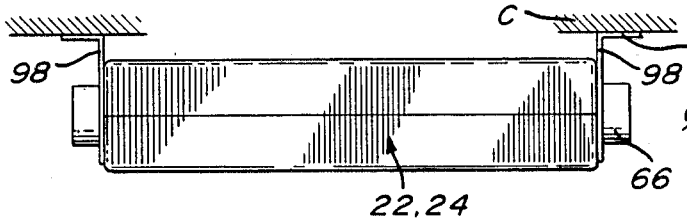
FIGS. 15 and 16 are side elevations of the heat exchanger as suspended from a ceiling.
Figure 16:
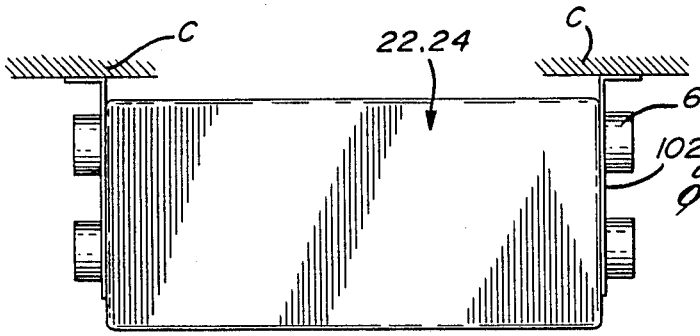
Figure 17:
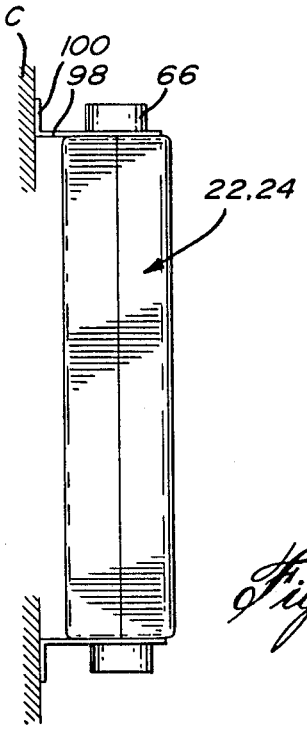
FIG. 17 is a side elevation of the heat exchanger as secured to a wall.
Figure 18:
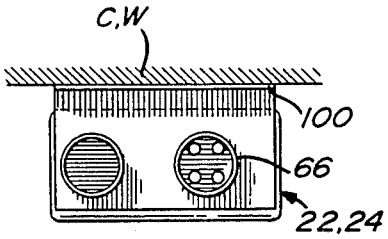
FIG. 18 is an end elevation of the heat, exchanger as suspended from the ceiling in the position of FIG. 15 or attached to a wall in the position of FIG. 17.
Figure 21:
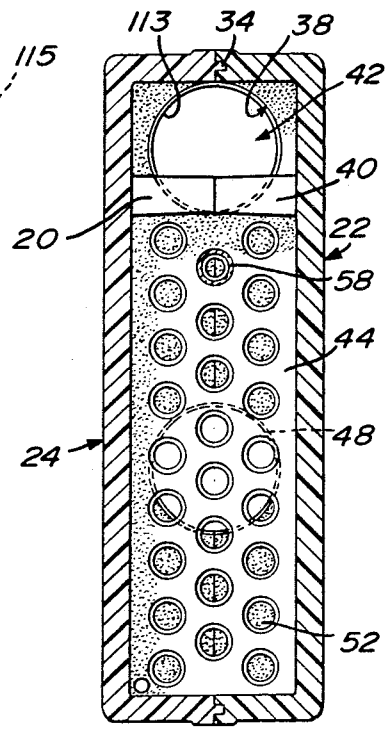
FIG. 21 is a section taken along line 21—21 of FIG. 20 but with the top half-part in position.

The heat exchanger can be very easily installed in a plurality of orientations, depending on the particular requirements. As shown in FIGS. 15 to 18, end brackets 98 are provided with a right angle flange 100 and with two apertures to receive the nipples 66, so that the casing can be suspended from a ceiling C in horizontal position, as shown in FIG. 15, or flat against a wall W, as shown in FIG. 17. A similar bracket 102 can be provided for attaching the casing to the underside of a ceiling C, as shown in FIG. 16, but with the casing vertical in widthwise direction.

These brackets 98 or 102 permit easy removal of the casing for servicing, whenever required.

Figure 14:
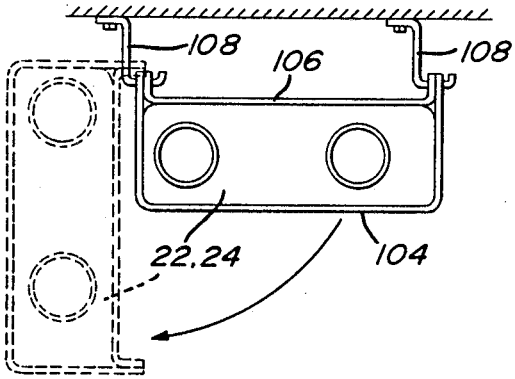
FIG. 14 shows an end view of the heat exchanger as suspended from a ceiling in either operative horizontal position, in full lines, or in inoperative vertical released position, in dotted lines, in accordance with the embodiment shown in FIG. 9.

For the casing provided with the bushing 72 of FIG. 9, ceiling suspensions means, as shown in FIG. 14, are preferably provided. In this figure, a U-shape strap 104 surrounds the bottom and sides of the casing and is complemented with another strap 106, each apertured at their ends for removable insertion into a hook 108 fixed to the ceiling. These hooks 108 permit detachment of the straps 104, 106 for pivoting of the casing to a downward position, as shown in dotted line in FIG. 14, whereby the two straps 104 can be separated for removal of the casing for servicing. Obviously, a pair of straps 104, 106 will be provided at each end portion of the casing.

FIGS. 26 to 28 show another embodiment of the strapping and hooks to suspend the heat exchanger in any position from the ceiling or to attach it to a wall, each of the two straps 118 is of a single length to completely encircle the heat exchanger casing being out turned and secured together at their ends by bolts and nuts 119. The portions of each strap 118 at each corner of the casing are bent at right angles so as to leave a space between the strap and the rounded corner of the casing for the insertion of a hook 120 which may be secured at its other end to a ceiling or to a wall depending on the way the heat exchanger is to be installed.

Because glass tubes are used in the heat exchanger, they can be easily inspected for cleanliness; they are completely corrosion-resistant, and it has also been found that humid air flowing through the tubes achieves a very high heat exchanging efficiency. These tubes can be easily cleaned on the outside and the inside.

At least the interior surface of the casing can be provided with a skin formed during the molding process and which prevents adherence of bacteria.

What is claimed is:

1. An air-to-air heat exchanger comprising: an elongated box-shaped casing, made of heat-insulating material, a plurality of glass tubes extending longitudinally within said casing and having opposite tapered ends, end chambers formed within said casing and in respective communication with the ends of said glass tubes and having first inlet and outlet ports for circulation of air through said glass tubes in a first air path, said end chambers each including a partition wall extending transversely of said casing and having through-bores with a tapered portion to receive and axially retain the tapered ends of said glass tubes; said casing having second inlet and outlet ports and baffles extending within said casing about a plane at right angle to that of said glass tubes for the circulation of air around said glass tubes in zig-zag manner in a second air flow path; and wherein said casing is made of two half-parts, each having a main wall and a skirt defined by two longitudinal side walls and two end walls with the skirt having a free edge, the free edges of the two casing half-parts adapted to contact each other, with said longitudinal side walls and said end walls matching in pairs, a tongue-and-groove arrangement along said free edges to sealingly close said two casing half-parts, said inlet and outlet ports being of circular shape and defined by matching half-circular openings made in the end walls of two casing half-parts.

2. An air-to-air heat exchanger as defined in claim 1, wherein said tongue-and-groove arrangement includes for each casing half-part a tongue extending around half the periphery of its free edge and a groove extending around the other half of the periphery of its free edge, the two half-parts being identical and, when reversed and matched to form the closed casing, the tongue of one half-part engages the groove of the other half-part and vice versa.

3. An air-to-air heat exchanger as defined in claim 1, wherein the partition walls and said baffles are plate-like members removably inserted and supported in grooves made at the inside surfaces of said longitudinal side walls and of the main walls, said baffles extending transversely of said casing from one matching pair of longitudinal side walls towards but short of the other matching pair of longitudinal side walls, said baffles having circular holes for frictionally receiving intermediate portions of said glass tubes.

4. An air-to air heat exchanger as defined in claim 3, wherein said end chambers each further includes an internal wall each integrally extending from a main wall and an end wall of each of said casing half-parts and having a free edge coincident with the free edge of said skirt, one of the internal walls having a tongue and the other one a groove for sealingly mating with the groove and tongue of the internal wall of the other casing half-part, each internal wall having a groove at its free end to releasably receive an end edge of said partition wall.

5. An air-to air heat exchanger as defined in claim 4, wherein said first inlet and outlet ports are in alignment longitudinally of the casing and said second inlet and outlet ports are in alignment longitudinally of the casing and close to one matching pair of longitudinal side walls, said internal walls being inwardly directed from the respective end walls in a direction towards said one matching pair of longitudinal side walls.

6. An air-to-air heat exchanger as defined in claim 1, wherein each of said inlet and outlet ports includes a cylindrical nipple with an outwardly-directed flange at one end removably inserted in a groove made in said end walls about said half-circular openings.

7. An air-to-air heat exchanger as defined in claim 1, wherein each of said inlet and outlet ports includes a double-flanged bushing lining said mating half-circular openings with its flanges engaging the inner and outer surfaces of said end walls, said bushing adapted to frictionally receive a cylindrical conduit.

8. An air-to-air heat exchanger as defined in claim 7, further including means to prevent axial detachment of said conduit from within said bushing.

9. An air-to-air heat exchanger as defined in claim 6, further including bracket means for securing said exchanger to a supporting surface, said bracket means including plates with apertures for receiving the nipples, with said plates applied against the matching pair of end walls.

10. An air-to-air heat exchanger as defined in claim 7, further including means to removably secure said heat exchanger to a supporting surface including, in combination, hooks adapted to be attached to said supporting surface, a first U-shape strap to surround one main wall and the two matching pairs of longitudinal side walls of said casing, a second strap extending between the legs of said first strap and adapted to overlie the other main wall of said casing, the two straps having contiguous respective ends which are apertured to removably receive said hooks.

11. An air-to-air heat exchanger as defined in claim 1, wherein said casing half-parts are made of a closed cell thermoplastic material.

12. An air-to-air heat exchanger as defined in claim 1, further including a relatively rigid envelope surrounding said casing half-parts and each made of two half-parts defining longitudinal side walls with inwardly-folded longitudinal hook-shaped edge portions, and further including a clamping member in the form of a strip with inturned longitudinal edges mutually engageable with the hook-shaped edge portions of said envelope half-parts.

13. An air-to-air heat exchanger as defined in claim 1, further including two end caps removably fitted over the respective ends of the two casing half-parts to maintain the same in closed position, said end caps having openings in register with the inlet and outlet ports.

14. An air-to-air heat exchanger as defined in claim 13, wherein each opening of each end cap is provided with a circular flange engaging the corresponding inlet or outlet port of the casing and adapted to frictionally receive a cylindrical conduit.

15. An air-to-air heat exchanger as defined in claim 14, further including a relatively rigid envelope surrounding said casing half-parts, but terminating short of the ends of the same, the latter envelope made of two half-parts defining longitudinal side walls terminating short of the junction of the two casing half-parts, the end caps fitting over said envelope half-parts and further including a strip of pressure adhesive applied to the end caps and to the envelope half-parts along said junction.

16. An air-to-air heat exchanger as defined in claim 13, further including means to removably secure said heat exchanger to a surface including in combination hooks adapted to be attached to said surface, a pair of straps surrounding spaced portions of said casing and each attached together at said ends, said straps being bent at right angles at the corners of said casing, said corners being rounded whereby a space is formed between said rounded corners and the bent portions of said straps to therefore define a gap for insertion of said hooks.

17. A heat exchanger comprising: an elongated box-like casing consisting of two end walls, two side walls, and two main walls; said casing defining a main intermediate chamber, and two end chambers, each sealingly separated from said main chamber; each end chamber bonded by an end wall, one side wall, both main walls, a short wall inwardly projecting from an intermediate section of the corresponding end wall, and a partition plate interconnecting the inner edge of said short wall to said one side wall, said partition plate parallel to said end walls; a first inlet port in one end wall, opening into said main chamber adjacent the other side wall; a first outlet port in the other end wall opening into said main chamber adjacent said other side wall; a number of baffle plates mounted within said main chamber parallel to said end walls spacedly one from the other and spacedly inwardly of the partition plates, said baffle plates shorter than said end walls, successive baffle plates alternately secured to said one and other side walls, the baffle plate proximate one end wall mounted to said other side wall and the baffle plate proximate the other end wall mounted to said said other side wall; a plurality of bores in said partition and baffle plates, one partition plate having the same number of bores as the other partition plate, the partition plate bores registering with one another, all the bores of a given baffle plate registering with a fraction of the total of partition plate bores; a plurality of cylindrical glass tubes operatively interconnecting said end chambers in seal-tight fashion by sealingly engaging each pair of registering partition plate bores and by sealingly passing through registering bores of at least some of said baffle plates; a second inlet port in the same end wall as said first outlet port but opening into one end chamber; a second outlet port in the other end wall opening into the other end chamber; so arranged that a first fluid can flow from said second inlet port to said second outlet port via said glass tubes, about a first generally straight flow path; and that a second fluid can flow from said first inlet port to said first outlet port via said main chamber, passing around and transverse to said glass tubes between each successive pair of plates, about a second generally sinusoidal flow path; said second flow path defining along a major portion thereof a number of straight flow path segments generally orthogonal to said glass tubes, whereby good thermal exchange occurs between said first and second fluids.

18. A heat exchanger as defined in claim 17, wherein each said end chamber short wall coverges toward the proximate casing side wall but extends short thereof.

* * * * *